United States Patent [19]

Hirsh

[11] Patent Number: 4,996,996

[45] Date of Patent: Mar. 5, 1991

[54] WEAVING COMB

[76] Inventor: Laurence S. Hirsh, 13504 Moorpark St., #2, Sherman Oaks, Calif. 91423

[21] Appl. No.: 281,815

[22] Filed: Dec. 8, 1988

[51] Int. Cl.[5] ..... A45D 24/00

[52] U.S. Cl. ..... 132/160; 132/219

[58] Field of Search ..... 132/219, 107, 901, 125, 132/126, 139, 140, 142, 150, 159, 160, 161

[56] References Cited

U.S. PATENT DOCUMENTS

| | | | |
|---|---|---|---|
| 952,491 | 3/1910 | Youngs | 132/901 |
| 2,216,355 | 10/1940 | Pollock | 132/160 |
| 2,596,296 | 5/1952 | Shields | 132/139 |
| 2,915,071 | 12/1959 | Watkins | 132/901 |
| 4,325,393 | 4/1982 | Thomas | 132/160 |

FOREIGN PATENT DOCUMENTS

| | | | |
|---|---|---|---|
| 2349546 | 4/1974 | Fed. Rep. of Germany | 132/219 |
| 1600472 | 7/1970 | France | 132/150 |
| 275627 | 5/1951 | Switzerland | 132/160 |

*Primary Examiner*—John G. Weiss

*Attorney, Agent, or Firm*—William M. Harris

[57] ABSTRACT

A weaving tool for use in the hairstyling arts allowing rapid and accurate gathering of uniformly spaced strands of hair for weaving, coloring, perming or cutting. The tool comprises a comb with teeth having a single hook located in the forward inside edge of each tooth. When the teeth are drawn through the hair the hooks engage multiple uniformly spaced strands of hair in a single movement. This saves time by eliminating the extra operation required by the present state of the art of multiply passing a pointed instrument in a zig-zag fashion through sections of hair grasped between the fingers. In addition, the present state of the art does not produce uniformly spaced strands of hair.

1 Claim, 1 Drawing Sheet

WEAVING COMB

BACKGROUND—FIELD OF INVENTION

The present invention is related generally to a hair styling tool preferably in the form of a comb wherein each tooth of the comb has a hair engaging means comprising a single hook allowing a plurality of uniformly spaced strands of hair to be rapidly and accurately gathered for the purpose of weaving, coloring, perming or cutting.

BACKGROUND—DISCUSSION OF RELATED ART

Watkins in U.S. Pat. No. 2,915,071 describes a special purpose comb primarily designed for use in giving "flat top" clipper cuts. The comb has an offset handle with teeth arranged in a concave shape to conform to the normal contour of a human head. Each tooth of this comb has a plurality of hair engaging notches in the forward edge of the tooth designed to engage and arrange the hair in a position for clipping. Watkins' is specifically designed for clipping hair. The offset handle is to keep the hand away from the cutting area and the plurality of notches in each tooth cause all of the hair in a section to stand up so the hair may be cut evenly in a "flat top." Because the comb engages and raises all of the hair in a section the comb is impossible to use for weaving alternate sections of hair. The present invention in contrast has the advantage of facilitating weaving by lifting up only selected strands on the single hook in each tooth.

The current state of the art in weaving hair involves grasping a section of hair between the fingers and passing the pointed handle of a rattail comb through the section of hair in a zag-zag fashion with multiple passes per section. The fingers then release the hair and a plurality of strands of hair remains suspended on the pointed handle of the comb ready for weaving, coloring, perming or any other procedure. In addition to being time consuming this method has the disadvantage of producing nonuniform hair strand spacing.

SUMMARY OF THE INVENTION

With the above discussion in mind, it is the object of the present invention to provide an easy and rapid means of separating uniform sized strands from the main body of hair. This is accomplished by a weaving tool with hair engaging means preferably in the form of a comb wherein each tooth of the comb has a hook in the forward edge of the tooth or. The comb is drawn through the hair and raised so that the hooks engage a plurality of uniformly spaced strands of hair in one movement. Another embodiment of the invention comprises a brush with a hook in each spike. Thus it is seen that the present invention provides a significant advantage over the prior art in saving time and producing uniformly spaced strands of hair.

DESCRIPTION OF THE PREFERRED EMBODIMENTS

Figure 1:
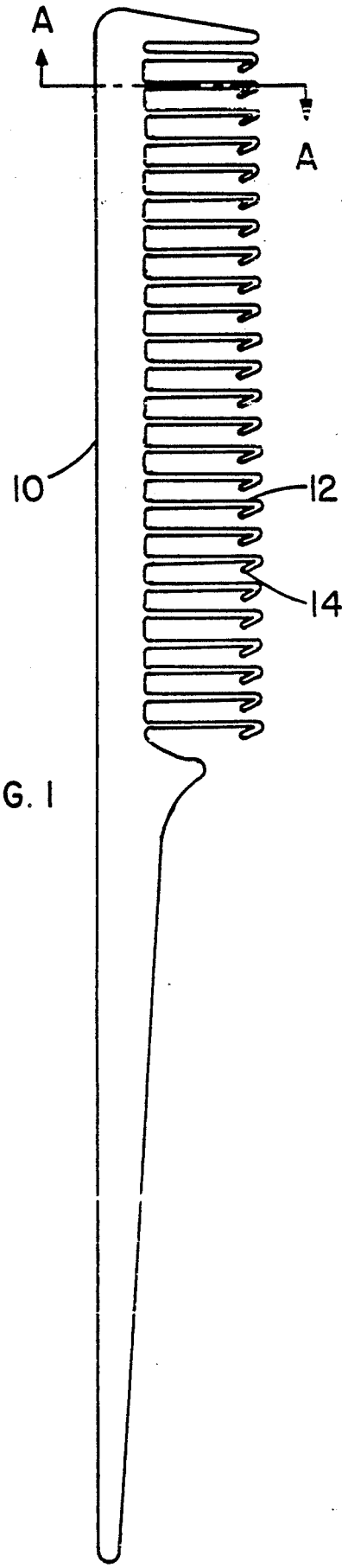
FIG. 1 is a side view of the comb showing the single hook in each tooth.

Referring now to the drawings the first embodiment and the best mode of carrying out the invention is shown in FIG. 1 comprising a comb 10 with a plurality of parallel rows of teeth 12 with hair engaging hooked tips 14. Comb 10 is preferably fabricated from plastic or hard rubber although a suitable metal may be used.

Figure 2:
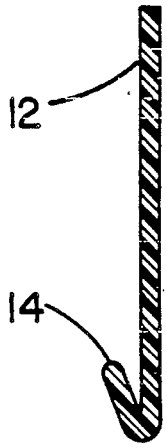
FIG. 2 is an enlarged longitudinal cross-sectional view taken in the plane of line A—A of FIG. 1 of a tooth showing the hooked tip.
Figure 3:
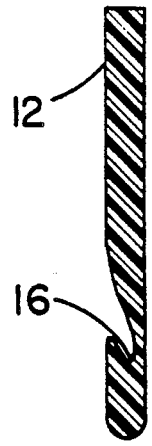
Figure 4:
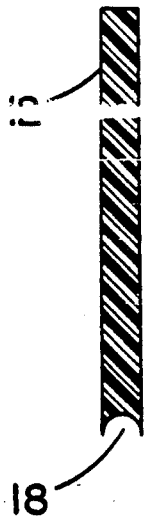

FIG. 2 shows tooth 12 with hair engaging hooked tips 14 in an enlarged longitudinal cross-sectional view wherein the hook is formed by molding or bending the tip of tooth 12 at an acute angle to the body of the tooth. When comb 10 is drawn through the hair with the teeth 12 in a downwards orientation and raised above the scalp hooks 14 engage and separate from the main body of hair a plurality of uniformly spaced strands of hair in one movement.

The invention being thus described in its various embodiments, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A comb for use in the hairstyling arts which gathers and engages uniformly spaced strands of hair rapidly and accurately for the purpose of weaving comprising:

a comb;

a plurality of parallel teeth of equal length;

a single hook located at the top of the forward inside edge of each of said teeth said hooks forming an acute angle with the inside edge of said teeth, whereby said hooks retentively engage the strands of hair said hook's acute angle are bent along the longitudinal axis of the comb.

* * * * *